United States Patent [19]

Carroll

[11] 4,247,114

[45] Jan. 27, 1981

[54] BOARD GAME

[76] Inventor: James F. Carroll, 501 Estelle St., Blackwood, N.J. 08012

[21] Appl. No.: 35,227

[22] Filed: May 2, 1979

[51] Int. Cl.[3] ..... A63F 9/04

[52] U.S. Cl. ..... 273/274; 273/146

[58] Field of Search ..... 273/268, 274, 146

[56] References Cited

FOREIGN PATENT DOCUMENTS

| | | | |
|---|---|---|---|
| 949733 | 2/1964 | United Kingdom | 273/274 |
| 953742 | 4/1964 | United Kingdom | 273/274 |
| 1532624 | 11/1978 | United Kingdom | 273/274 |

*Primary Examiner*—A. O. Oechsle

*Attorney, Agent, or Firm*—Duffield & Lehrer

[57] ABSTRACT

A playing surface includes a center area surrounded by a wall within which are intended to be thrown three dice each having a color different from the other two. A first betting area adjacent the center area is identified by the color of one of the dice and is divided into six spaces corresponding to the six faces of the one die. A second betting area also located adjacent the center area is arranged similar to the first betting area but is identified by a color which is the same as the color of one of the other dice. Other areas are provided for betting evens or odds or doubles. A plurality of betting chips are adapted to be selectively placed on the various betting areas.

3 Claims, 2 Drawing Figures

BOARD GAME

BACKGROUND OF THE INVENTION

The present invention is directed toward a board game and more particularly toward a game of chance employing dice which is intended to be played in a gambling casino but which is also practical as a family parlor game.

With the opening of gambling casinos on the east coast of the United States and more particularly in Atlantic City, New Jersey, there has recently been a renewed interest in casino type games. A popular game in casinos is craps which is a game of chance played with two dice. While craps is an extremely exciting game, the rules thereof are relatively complex. As a result, only experienced gamblers tend to play and amateurs normally shy away. There has, therefore, been a need for a game of chance which has the excitement of craps but which is simpler to play and understand so that inexperienced gamblers can play.

SUMMARY OF THE INVENTION

The present invention is believed to satisfy this need by providing a game of chance which is substantially simpler than craps. This is accomplished by a playing surface which includes a center area surrounded by a wall within which are intended to be thrown three dice each having a color different from the other two. A first betting area adjacent the center area is identified by the color of one of the dice and is divided into six spaces corresponding to the six faces of the one die. A second betting area also located adjacent the center area is arranged similar to the first betting area but is identified by a color which is the same as the color of one of the other dice. Other areas are provided for betting evens or odds or doubles. A plurality of betting chips are adapted to be selectively placed on the various betting areas.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
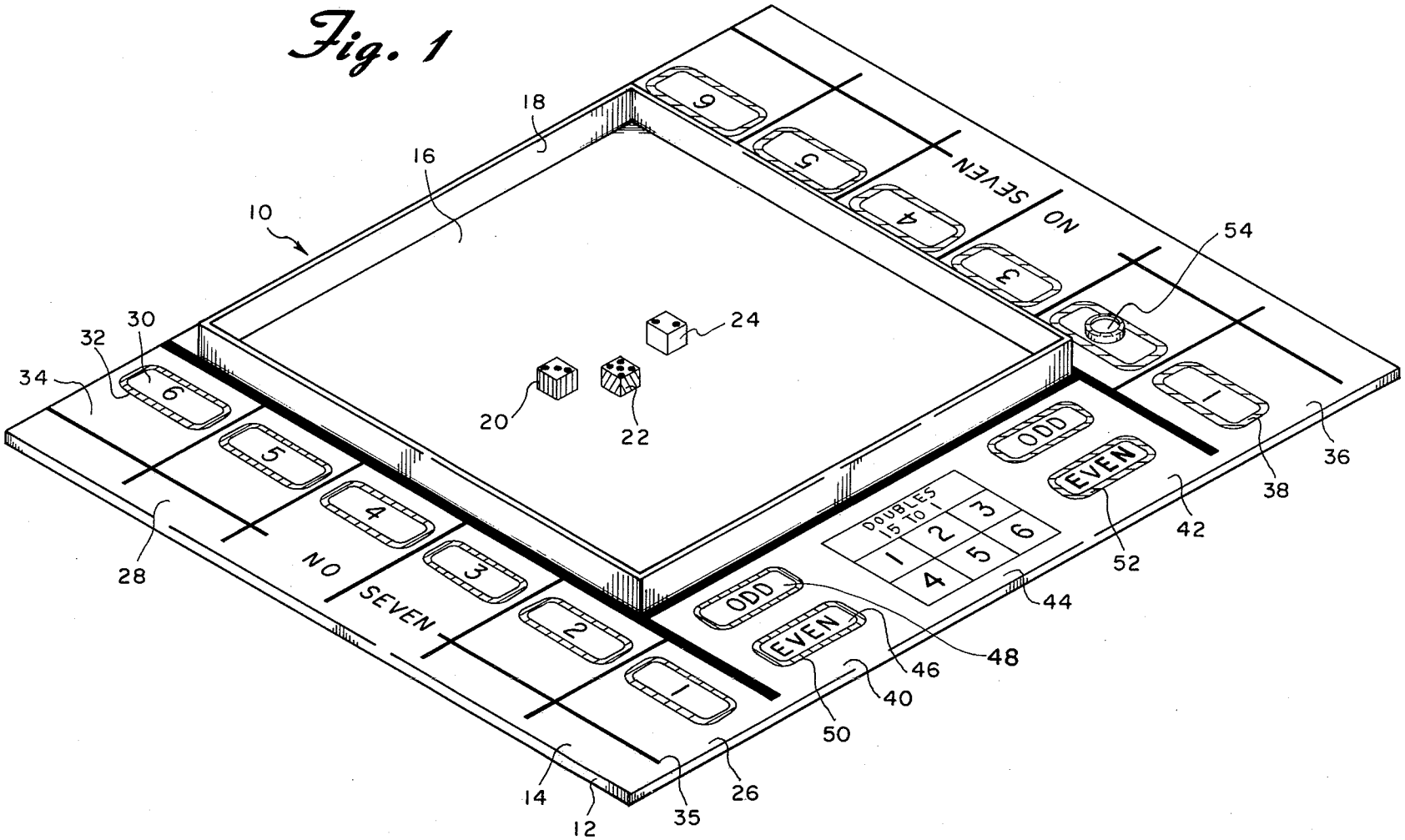
FIG. 1 is a perspective view of a board game constructed in accordance with the principles of the present invention.

Referring now to the drawings in detail wherein like reference numerals have been used throughout the various figures to designate like elements, there is shown in FIG. 1 a board game constructed in accordance with the principles of the present invention and designated generally as 10. Board game 10 includes a board 12 having an upper playing surface 14 thereon.

Playing surface 14 is divided into a plurality of areas. A substantially centrally located area 16 is surrounded by a short wall 18. Preferably, the upper surface 14 in the central area 16 is covered with a felt material or the like. This will prevent the dice which are to be thrown in the area from sliding and causes them to roll.

Three dice 20, 22 and 24 are provided for the play of the game. The three dice are conventional six-sided dice having indicia on the faces thereof representing the numbers 1–6 respectively. The three dice, however, are of different colors. For example, in the embodiments shown, die 20 is red, die 22 is green and die 24 is white.

Also located on the playing surface 14 adjacent the center area 16 is a first betting area 26. Betting area 26 is divided into six spaces 28. Each of the six spaces 28 is identified by a different one of the numbers 1–6, respectively.

Each of the spaces 28 is also comprised of two parts. The first part being the numbered area 30 which, as shown in FIG. 1, is surrounded by a colored line 32. The color of the lines 32 is red which corresponds to the color of the die 20. The other part of each of the spaces 28 is another area 34 which is of approximately the same size as the area encompassed by the line 32 referred to as the "No Seven Area" on the board and represented by a black line 35 running from one end of the board to the other end.

On the opposite end of the playing surface 14 is located another betting area 36. Betting area 36 is substantially identical to betting area 26 and accordingly a detailed description thereof is not believed necessary. The only difference between betting area 36 and betting area 26 is in the color of the lines 38. As shown in FIG. 1, lines 38 are green thereby corresponding to the color of die 22. There is no betting area on the playing surface 14 which corresponds to the color of the die 24.

Located between the betting areas 26 and 36 on the playing surface 14 are additional betting areas 40, 42 and 44. Betting area 40 is divided into two areas 46 and 48 identified by the words "even" and "odd", respectively. Each of the areas 46 and 48 is surrounded by a red line 50. Betting area 42 is substantially identical to betting area 40 except that the area around the words "odd" and "even" is surrounded by a green line 52.

Betting area 44 which is located between the areas 40 and 42 is also divided into a plurality of portions which are numbered 1–6. As will become apparent hereinafter, however, this betting area 44 is used in a different manner from the betting areas 26 and 36. Completing the game apparatus are a plurality of chips or betting tokens or the like which are adapted to be placed in the various betting areas by the players placing a bet. One such chip is shown, for example, as 54. Chips of various colors could be provided with the various colors representing different values or denominations.

Figure 2:
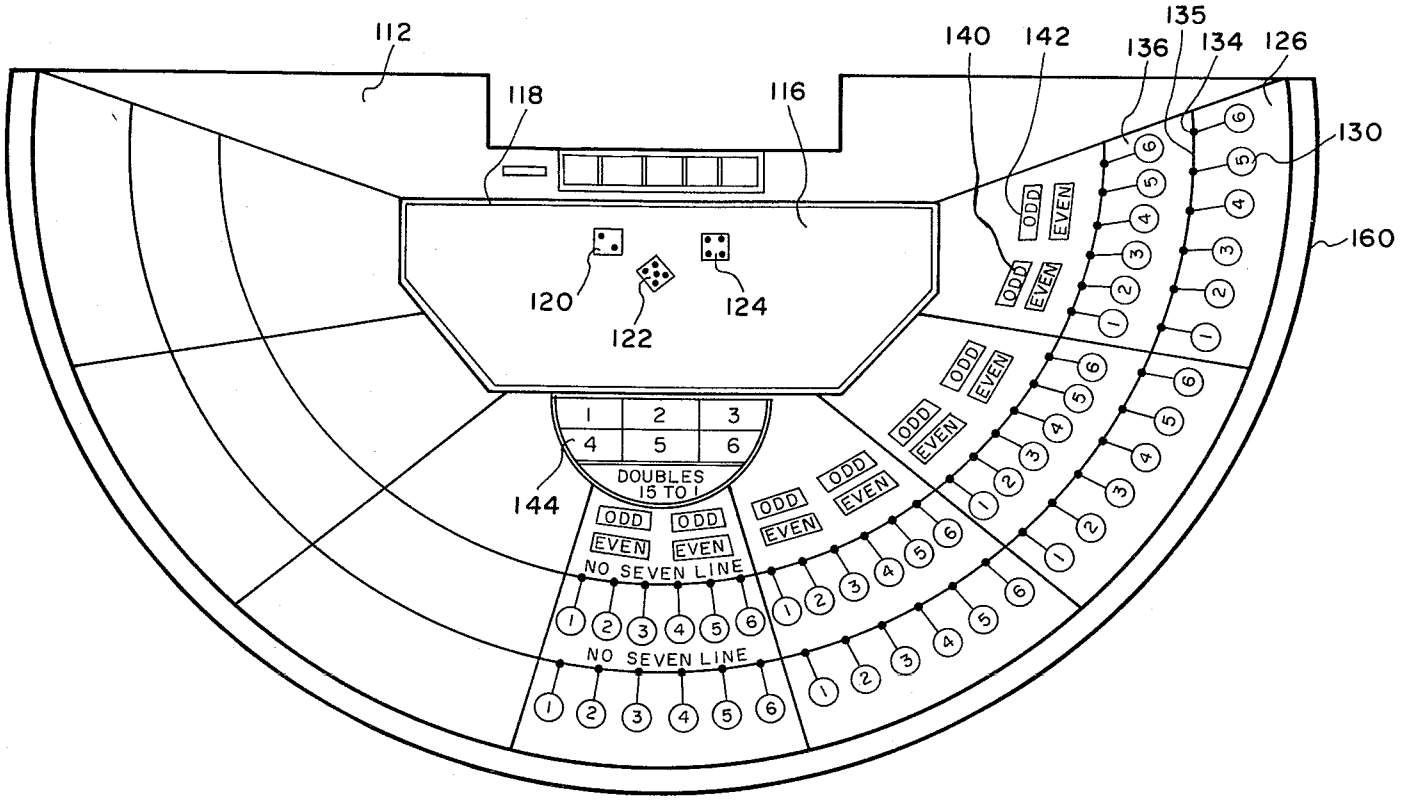
FIG. 2 is a top plan view of a modified form of the invention shown in FIG. 1.

A variation of the game board shown in FIG. 1 is illustrated in FIG. 2. In this embodiment, the board 112 is substantially semicircularly shaped. As with the embodiment of FIG. 1, a central area 116 is provided which is intended to be used for tossing the dice 120, 122 and 124. Surrounding the central area 116 is a wall 118. Arranged around the central area 116 are a plurality of betting stations 160. While seven such stations are shown, it should be understood that a fewer or greater number could be provided. In addition, while only four of the betting stations 160 are shown in detail, it will be understood that each of the betting stations are similarly arranged.

Within each betting station 160 are arranged several betting areas. Betting area 126 includes a row of six red circles 130 which are numbered consecutively 1–6. Each of these circles has a line directed therefrom toward a common line 135 and join the line at a portion marked by a dot 134. Line 135 is referred to as the "No Seven Line" on the board and is represented by a black semicircular line running from one end of the board to the other end.

Also located within each betting station 160 is betting area 136. Again, betting area 136 is substantially identical to betting area 126 except that each of the six betting circles therein are green. Located above the betting areas 126 and 136 within each betting station 160 are two pairs of additional betting areas with indicia indicating "even" and "odd." Betting area 140 is indicated to be green and area 142 is red. Again, it should be remembered that while only one betting station 160 has been described in detail, each of the remaining betting stations are similarly constructed and arranged.

Located in front of the central playing area 116 is an additional betting area 144 which is similar to the betting area 44 of the embodiment shown in FIG. 1 in that it includes six spaces which are designated 1–6. While two different embodiments of the invention are shown, it will be seen that the two games are played in substantially the same manner. The embodiment of the invention shown in FIG. 1 is primarily intended to be a casino gambling game for playing in a standing position similar to a craps game and also a parlor type board game whereas the embodiment shown in FIG. 2 is adapted for use in a gambling casino for playing in a sitting position similar to a blackjack game. When used as a casino game, playing board 112 may actually be the top of a table or counter much like a blackjack table. It should be readily apparent that players will sit around the circumference of the table in front of each of the stations 160 and an operator will stand behind the central playing area 116. Only one operator would control the game whereas in a craps type game many operators are required to control the game.

While various rules for playing games utilizing the present apparatus may be developed, it is intended that the game be played in the manner to be now described. Furthermore, while the following description will make specific reference to the game shown in FIG. 1, it will become readily apparent that the apparatus shown in FIG. 2 is utilized in substantially the same manner.

Each of the players first purchases a plurality of chips 54. These are then placed on any of the betting areas previously described. For example, a player may place a chip on the red "6" or in the betting area 34 adjacent the red "6", known as the "No Seven Area", but not on the red "6". Similarly, chips can be played on the green numbers or the areas adjacent the green numbers and chips can be played on the red or green "even" or "odd" or on any of the doubles numbers. After the bets are placed, one player or the operator simultaneously throws all three of the dice into the central playing area 16. If the number showing on the red die is an even number, any player who bet red "even" will win a number of chips determined by some previously designated odds. This play can be made after each dice roll. Similarly, the players playing "odd" or "even" green will win if the green die comes up odd or even, respectively. If the red and green dice show doubles, any player playing the "doubles" betting area will win if the proper number were bet but only if the seven combination with the white die comes out on the dice roll to end a game.

In order for a player to win on both of the colored numbers, two criteria must be met. Firstly, the numbers must show up on the respective red or green die. In addition, however, either the red or green die must combine with the white die to equal seven to complete a game. For example, as shown in FIG. 1, the green die 22 shows a five which combined with the white die 24 equals seven and accordingly, players who played green five or red three would both win. Chips can be placed on or off the betting area 34, the "No Seven Area", after each roll of the dice. Chips placed in the red or green colored areas 32 and 38 must remain on those areas until the seven is made with the white die and the game is ended. Players preferring to play the "No Seven Area" 34 can win their bet after each roll of the dice providing they pick the correct red and green dice numbers where their chips are placed. The white die adds excitement to the game by giving the game a reasonable duration of playing time.

The present invention may be embodied in other specific forms without departing from the spirit or essential attributes thereof and accordingly, reference should be made to the appended claims rather than to the foregoing specification as indicating the scope of the invention.

I claim:

1. A board game comprising:

a game board having a playing surface on the upper surface thereof;

a center area on said playing surface, at least a substantial portion of the circumference of said center area being bounded by a wall extending upwardly from said surface;

first and second betting areas on said playing surface, each of said first and second betting areas being divided into six spaces with indicia on each of said spaces representing a different one of the numbers one to six, each of said spaces further being divided into two areas, said first betting area being identified by a first color and said second betting area being identified by a second color different from said first color, and three dice, each of said dice having six surfaces with indicia thereon identifying the faces with a different one of the numbers one to six, one of said dice representing said first betting area and being of said first color, the second of said dice representing said second betting area and being of said second color and the third of said dice being of a color different from said first and second colors, said third die not being representative of a betting area but being instrumental in the outcome of play.

2. A board game as claimed in claim 1 further including a plurality of first betting areas and a plurality of second betting areas.

3. A board game as claimed in claim 1 including an additional betting area divided into a plurality of six spaces which additional betting area is not identified by either said first or said second colors.

* * * * *